US007612290B1

(12) United States Patent
Le

(10) Patent No.: US 7,612,290 B1
(45) Date of Patent: Nov. 3, 2009

(54) FLEXIBLE HIGH SPEED MICRO-CABLE

(75) Inventor: Kevin D. Le, Richland Hills, TX (US)

(73) Assignee: Wiliams - Pyro, Inc., Fort Worth, TX (US)

( * ) Notice: Subject to any disclaimer, the term of this patent is extended or adjusted under 35 U.S.C. 154(b) by 0 days.

(21) Appl. No.: 12/132,989

(22) Filed: Jun. 4, 2008

(51) Int. Cl.
*H01B 7/08* (2006.01)

(52) U.S. Cl. ..... 174/117 F

(58) Field of Classification Search ..... 174/117 F, 174/117 FF, 117 A
See application file for complete search history.

(56) References Cited

U.S. PATENT DOCUMENTS 5,025,115 A * 6/1991 Sayegh et al. ..... 174/117 F
6,566,606 B1 * 5/2003 Hazy et al. ..... 174/113 R
6,717,057 B1 * 4/2004 Segall et al. ..... 174/117 FF
7,091,422 B1 * 8/2006 Stotz ..... 174/117 F

* cited by examiner

*Primary Examiner*—Chau N Nguyen
(74) *Attorney, Agent, or Firm*—Morani Patent Law, P.C.

(57) ABSTRACT

A flexible high speed micro-cable and method of making the same are described. The parallel conductors incorporated in the present cable contribute to the flat cross section of the cable, while the unique combination of materials yield a flexible cable with a low profile. The data transfer rate and transmission losses of a cable, as provided herein, exceed High Speed Universal Serial Bus (USB) 2.0 specifications and data transmission is achieved from USB devices. The lower volume and mass of the cable make it ideal for applications needing low mass payload, such as satellites. The flexible nature of the cable allow it to readily conform to a desired structure for mounting or routing. A flexible high speed micro-cable is fabricated from a unique combination of materials and fabrication can be readily automated.

2 Claims, 7 Drawing Sheets

100

FLEXIBLE HIGHSPEED MICRO-CABLE WITH COPPER EMI SHIELDING

FLEXIBLE HIGHSPEED MICRO-CABLE WITH INSULATION OVER COPPER EMI SHIELDING

VIDEO SIGNAL RECEIVED FROM A USB 2.0 DIGITAL CAMERA TRANSMITTED THROUGH A FLEXIBLE HIGHSPEED MICRO-CABLE

FLEXIBLE HIGH SPEED MICRO-CABLE

STATEMENT REGARDING FEDERALLY SPONSORED RESEARCH OR DEVELOPMENT

This invention was made with government support under Contract No. HQ0006-04-C-7092 between the Missile Defense Agency section of the U.S. Department of Defense and Williams-Pyro, Inc. The government has certain rights in the invention.

FIELD OF THE INVENTION

The present invention relates generally to light weight flexible cabling. More particularly, the present invention relates to providing a flat flexible micro-interconnect cable which provides high speed data transfer.

BACKGROUND OF THE INVENTION

Conventional wiring harnesses are composed of bundles of mechanically bound individual wires which are attached to the vehicle structure with mechanical tie-downs, and finished on each end with complex and expensive connectors. FIG. 1 shows a conventional satellite wiring harness.

As shown in FIG. 1, these conventional cables do not precisely conform to the surface structure on which or in which they are used.

Sophisticated spacecraft and air craft comprise a multitude of electronic systems which contribute to the volume and weight payload of the craft. The cables, interconnections between electronic components and systems, also contribute significantly to the weight and volume payload of aircraft, satellites, missiles and the like. Similar load constraints and electronic design demands exist in marine and unmanned vehicles.

For existing aerospace programs to succeed and for new systems to be successfully developed, small flexible cabling is desirable, and could even be necessary. In addition, for avionics based applications, in particular, cables must also be very reliable and meet applicable standards.

Conventional cabling is labor intensive with respect to engineering and manufacturing. Further, conventional cabling systems are difficult to install in a vehicle and require bulky support brackets and terminations.

In view of the conventional cabling characteristics and the demands on avionic systems in terms of reliability and minimal contribution to vehicle mass, it is easy to see that small, light, reliable cables are desired.

There are additional considerations for cables, that is ease of fabrication and ease of interfacing with connectors.

Applications other than aircraft, spacecraft, and missiles could also benefit from a reduction in the weight and volume of electronic system components while maintaining or even improving system reliability. For, example commercial aircraft now include various electronic services for passengers, even to the individual passenger level. This evolving service can contribute significantly to the weight of the aircraft. A flat flexible cable could, for example, be mounted within the walls of a structure, within a furnishing, or within the casing of a portable system.

USB is a serial bus standard to interface devices. The prevalence and variety of USB devices, which include human interface devices, has reached astronomic numbers. Consequently, small, flexible, reliable cabling which meets 2.0 USB standards will have a multitude of applications.

For satellite and other aerospace applications, in particular, yet another need may be a flat cable.

SUMMARY OF THE INVENTION

The present invention addresses some of the issues presented above by providing a working microscopically small cable, hereafter referred to as "a flexible high speed micro-cable" and method of making the same.

One aspect the present invention is the limited, microscopic thickness of the cable. One embodiment has a thickness of 350 μm.

A high speed USB 2.0 compatible cable, in accordance with the present invention is one step towards reducing or eliminating bulky black boxes and cables with a system that can be mounted on or within the structural wall of a vehicle.

Another aspect of the present invention is its positive contribution to payload mass fraction standards for electronics and cabling for aerospace applications and for other applications where light, reliable, USB connections are desired.

Another aspect of the present invention is that it provides USB 2.0 transmission capability in a microscopically small cable.

Another aspect of the present invention is that it provides high speed data transmission in a microscopically small flat cable, comprising parallel conductors in the absence of, for example, a twisted pair.

Another aspect of the present invention is that it meets USB 2.0 high speed electrical characteristics and USB 2.0 electrical requirements for USB micro-cables. (Universal Serial Bus Micro-USB Cables and Connectors Specification, Rev. 1.01, April 2007).

Another aspect of the present invention is that its cross section is small enough and its composition is flexible enough along its length that it can conform to bends or turns.

Another aspect of the present invention is that it employs conductors of only 120 μm diameter and yields a high speed functioning cable having for a cross section of less than 0.75 $mm^2$.

Another aspect of the present invention is that it is light weight reducing bulk and mass in all applications.

Still another aspect of the present invention is the relative ease its fabrication, which favors ease of automated production and ease of accuracy and consistency in production.

Still another aspect of the present invention is its combination of ready made materials and ease of manufacturing, in accordance with an embodiment of the present invention, yields a relatively low cost cable.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are merely illustrative of ways to make and use the invention, and do not limit the scope of the invention.

Figure 1:
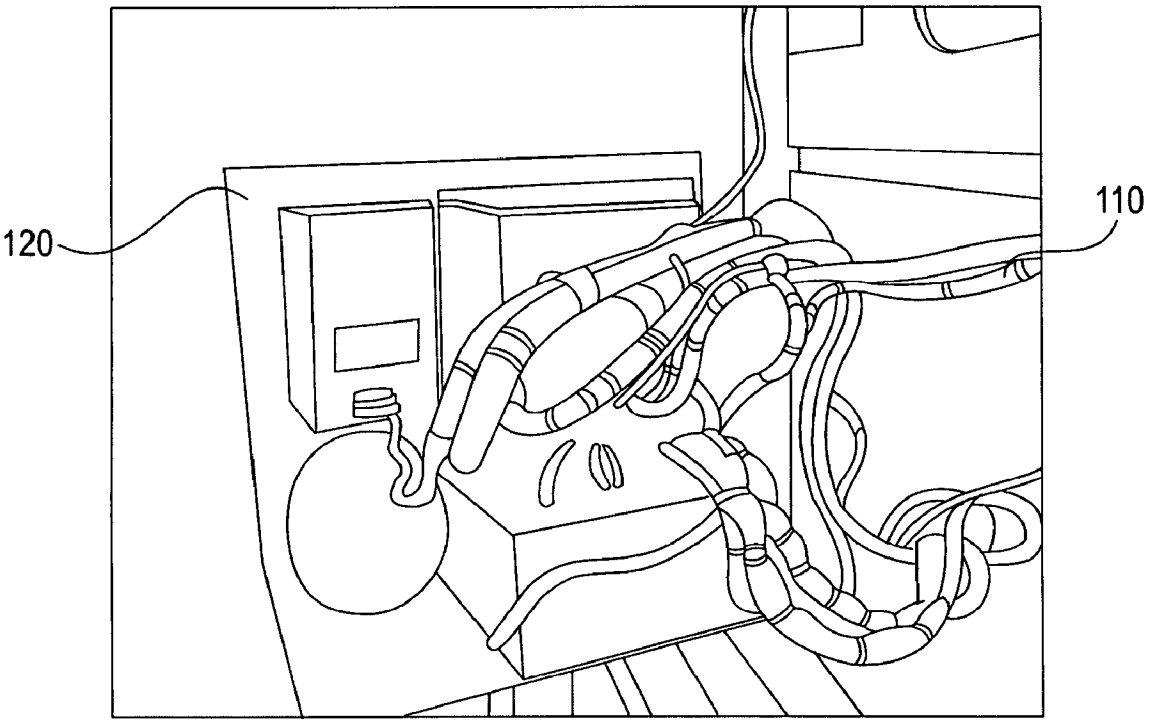
FIG. 1 PRIOR ART
FIG. 1 shows a conventional satellite wiring harness.

FIG. 1 shows a digital image taken of a traditional wiring harness for a satellite 100. The size and bulk of the conventional cabling 110 is readily apparent. These cables, interconnections between electronic components and systems, contribute significantly to the mass fraction of the satellite. Conventional cabling does not conform to the walls of the structure on which it is secured and its bulk prevents it from mounting flush with walls, contours, or edges 120.

Figure 2A:
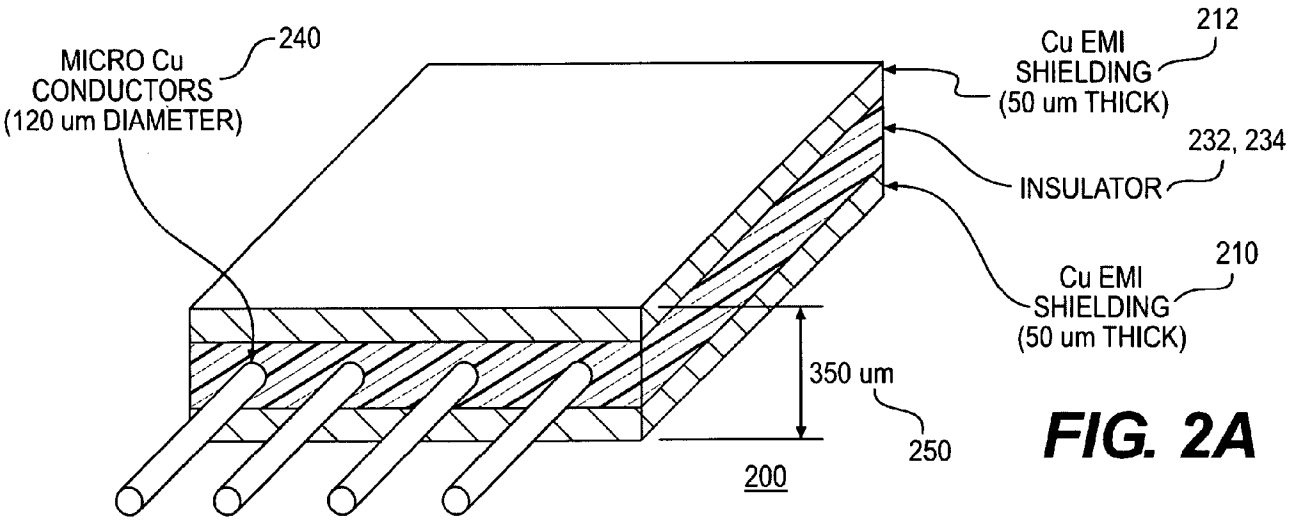
FIGS. 2A-2B show cross sectional structures of fabricated microscopic high-speed flexible USB 2.0 cables with a total thickness of 350 um in FIG. 2A and an outer insulation layer in FIG. 2B.
Figure 2B:
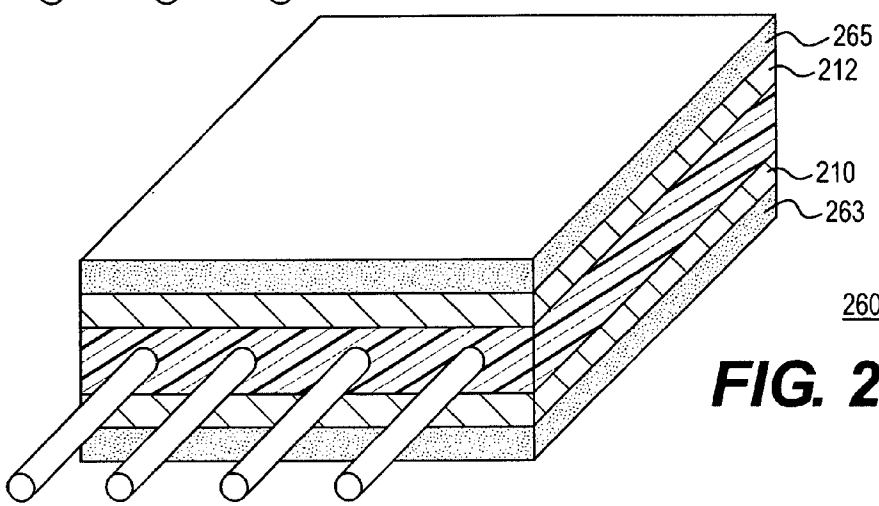
Figure 3A:
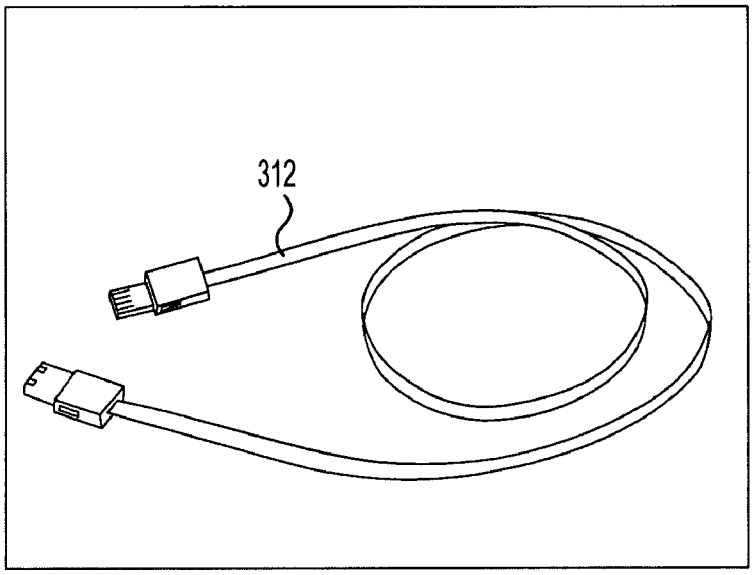
FIGS. 3A-3B show exemplary embodiments of flexible high speed micro-cables with an outermost copper shield and an outermost insulation layer, respectively, in accordance with the present invention.
Figure 3B:
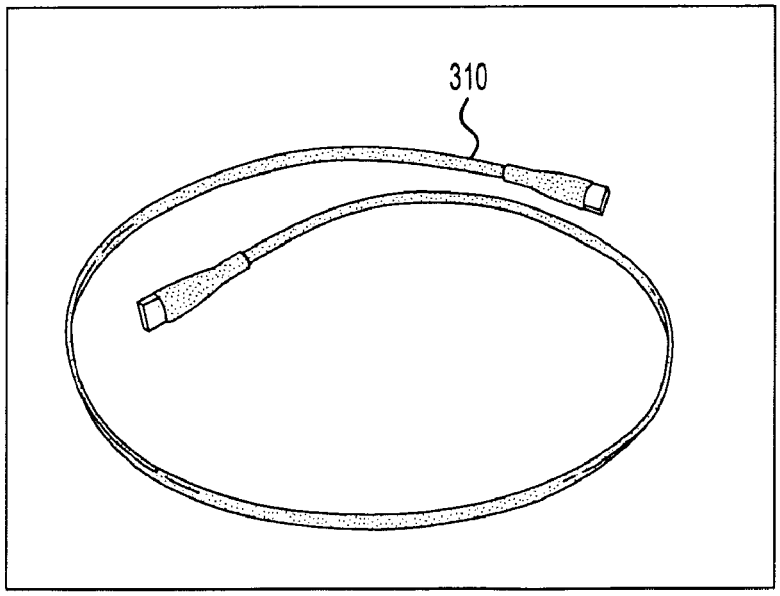

FIG. 2*a* shows the structure of a fabricated flexible high speed micro-cable, in accordance with an exemplary embodiment of the present invention, with a total thickness of 350 μm 250. The cable comprises 4 micro copper conductors having a 120 μm diameter 240. The copper conductors are sandwiched between two layers of polyimide KAPTON® tape 232,234 (E.I. Dupont de Nemours and Company, Wilmington, Del., USA). A layer of 50 μm adhesive copper tape 210, 212 is applied to the outside of each strip of polyimide KAPTON® tape 232, 234. The total width of this micro cable is 2 mm. A conventional USB 2.0 cable can have a 5.2 mm diameter including an outer mechanical protection layer, with a cross-sectional area of approximately 22 $mm^2$. Referring to FIG. 3*a*, a functional flat cable in accordance with the present invention can have a cross sectional area of less than 1 $mm^2$, where 0.350 mm thickness and a 2.0 mm width yield a cross sectional area of 0.7 $mm^2$. Depending on outer protection applied to the cable, such as standard heat shrink tube, the height of the cable may increase by about 1 mm, while the width can likewise increase. Referring to FIG. 3*b*, an outer layer of heat shrink protection 310 increases the protected cable height to 1.5 mm and the width to 5 mm. The outer layer of heat shrink tube 310 surrounds the copper electromagnetic interference (EMI) shielding 212, 210, shown in FIG. 2*a*. FIG. 2*b* shows the heat shrink layers 263, 265 added on the outer side of EMI shielding 210, 212. The flexible high speed USB 2.0 cable, in accordance with the present invention, reduces the bulk of the cable by a factor of 3, in turn, the mass is also greatly reduced.

Figure 2C:
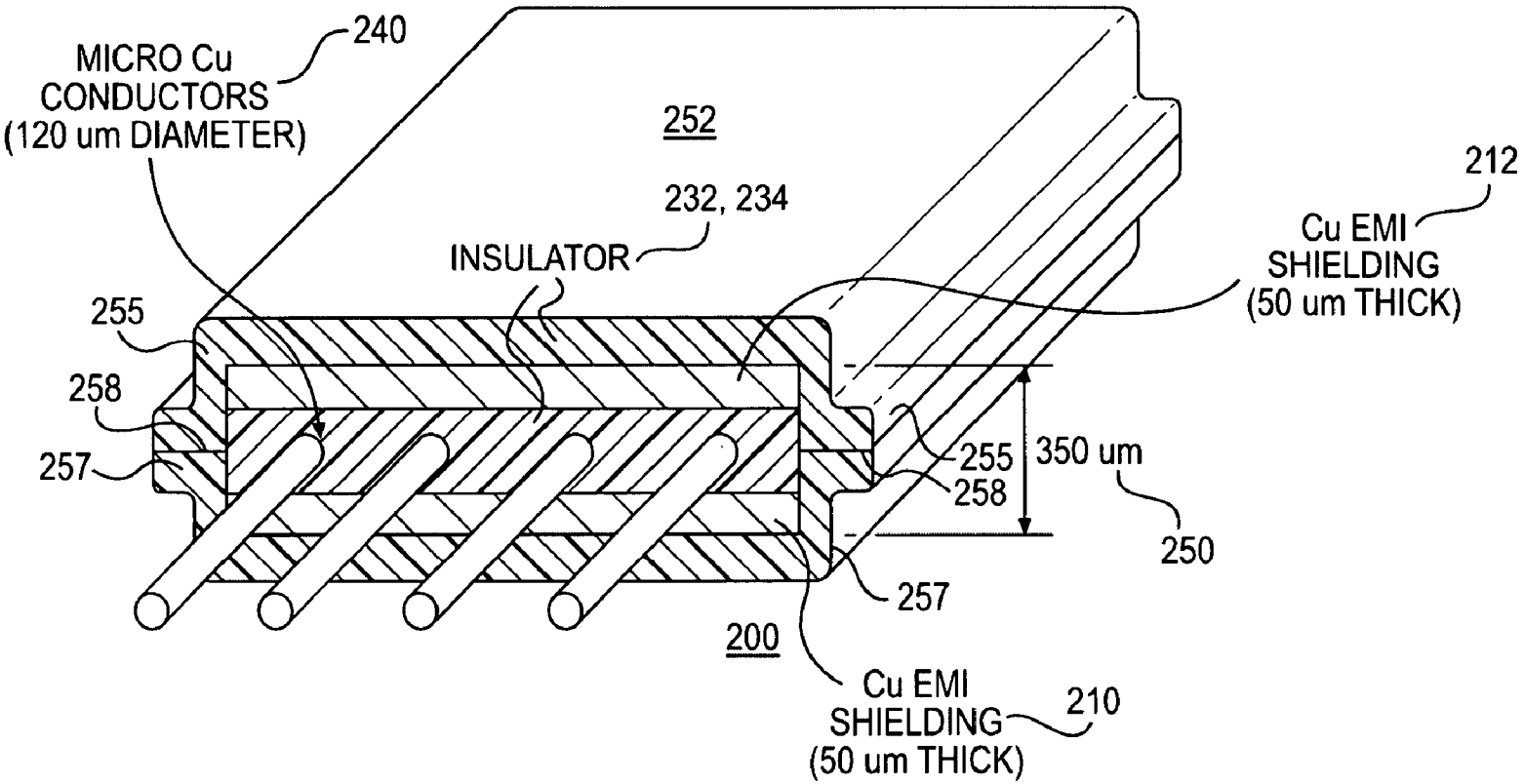
FIG. 2C shows cross sectional structures of a fabricated microscopic high-speed flexible USB 2.0 cable with an outer polyimide insulation layer.

FIG. 2*c* shows the application of an outer insulation 255, 257 along the length of an outside of the first and second copper tapes, 212, 210. An outer layer of polyimide tape 255, 257, such as polyimide KAPTON® tape, is applied to each exposed side of the first and second copper tape 212, 210, wherein the outer layer of polyimide tape 255, 257 has a greater width than a width of the copper tapes; and outer first and second edges of the outer layer polyimide tape, which are beyond the width of the copper tapes, are pressed together 258. As in cable 200 of FIG. 2*a*, the cable 252 in FIG. 2*b* comprises 4 micro copper conductors having a 120 μm diameter 240. The copper conductors are sandwiched between two layers of polyimide tape 232, 234. A layer of 50 μm adhesive copper tape 210, 212 is applied to the outside of each strip of polyimide tape 232, 234.

FIG. 3*a* shows a flexible high speed micro-cable with the copper EMI shielding exposed 312, while FIG. 3*b* shows a flexible high speed micro-cable with an outer layer of heat shrink tube 310 covering the copper EMI shielding, both in accordance with an embodiment of the present invention. The flexible high speed micro-cable has four parallel conductors, as opposed to the inner twisted pair of a conventional USB cable. The result is a flat cable which can be applied in situations where minimal height is desired or needed for clearance purposes. The flatness of the cable is readily discernable in FIGS. 3*a* and 3*b*, relative to the USB adapters attached to each end of the respective cables.

Figure 4:
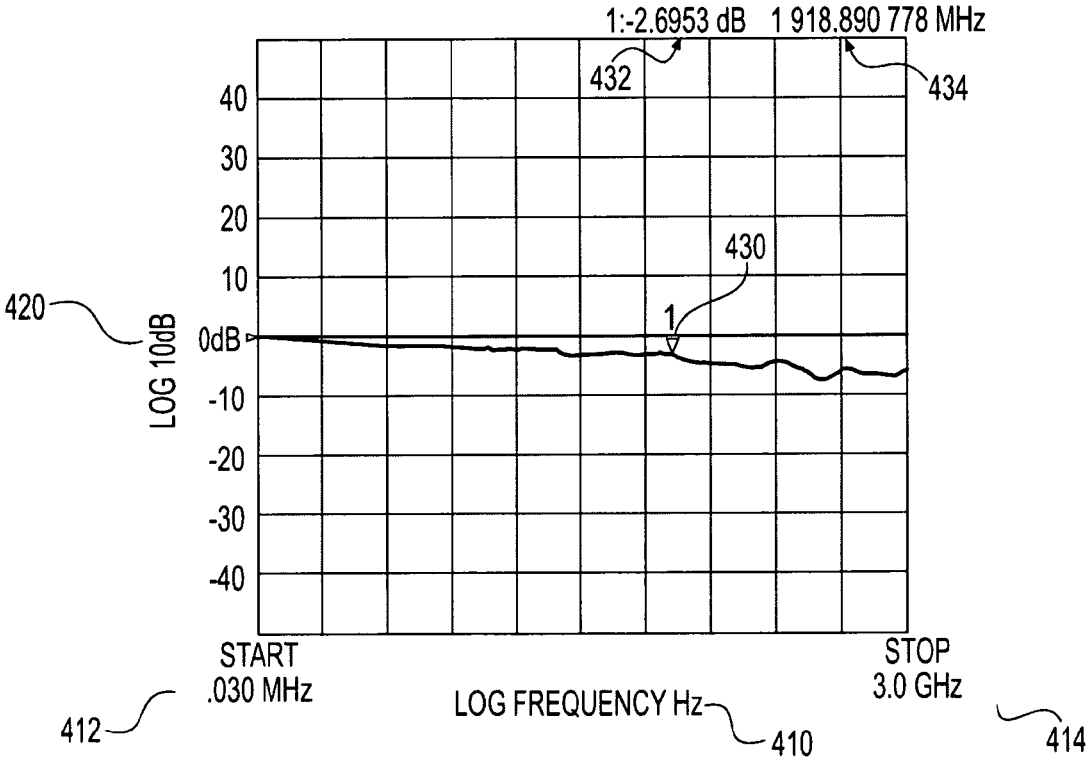
FIG. 4 shows the half power point measured in a transmission frequency test on a 25 cm long flat flexible high speed micro-cable made in accordance with an embodiment of the present invention.

FIG. 4 shows the signal strength measured in a 25 cm cable made in accordance with an embodiment of the present invention. The signal strength in decibels 420 is shown as a function of frequency in MHz 410, on a linear scale, 10%/div. Signal strength for frequencies between 0.030 MHz and 3000 MHz were measured. As shown in FIG. 4, the cable has a 3 dB bandwidth 430 near 2 GHz 434. The signal attenuation of a cable in accordance with the present invention surpasses the USB standard for 3.2 dB of cable losses at a frequency of 200 MHz.

Figure 5:
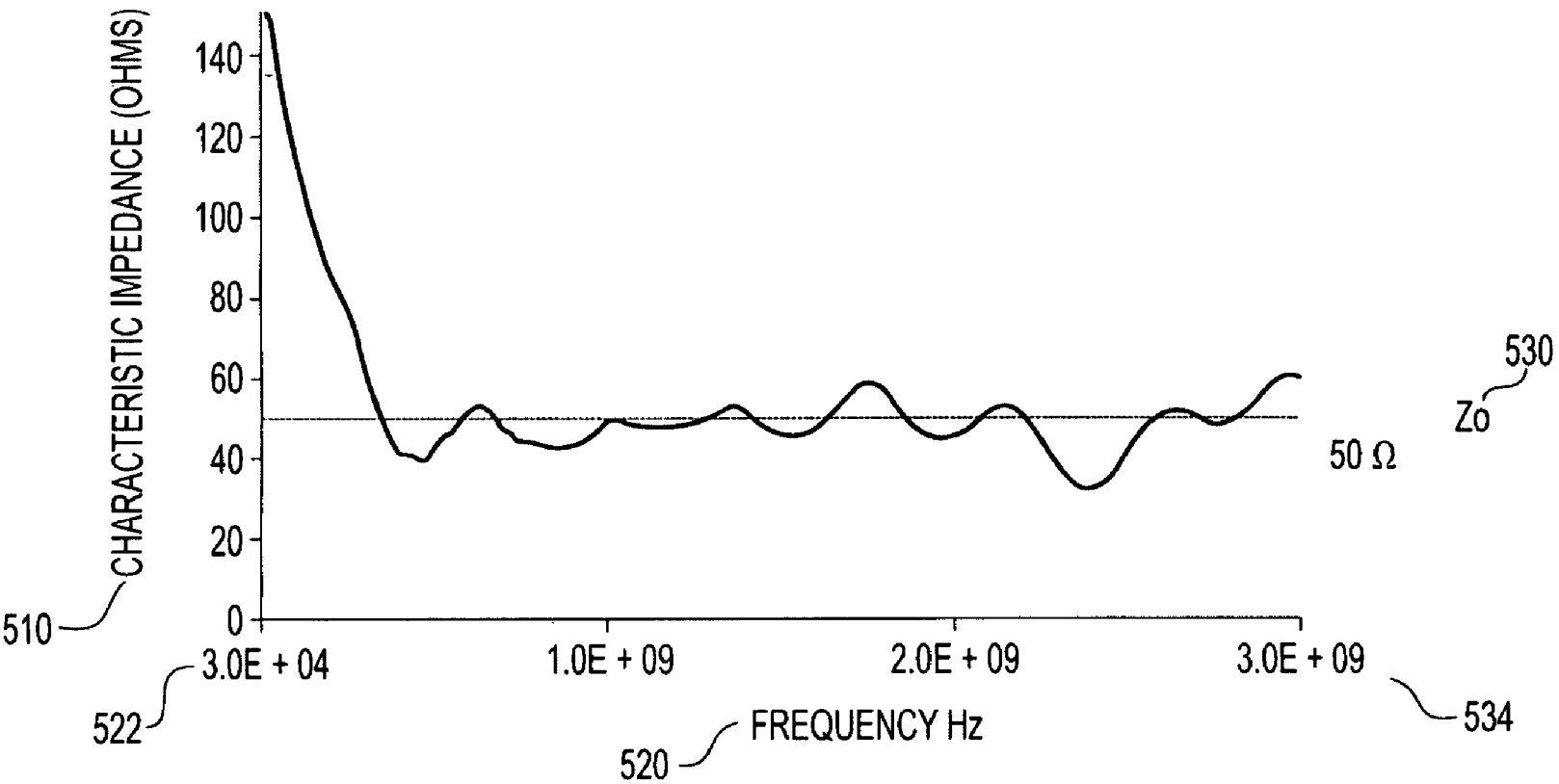
FIG. 5 shows the measured characteristic impedance of a 25 cm long flat flexible high speed micro-cable made in accordance with an embodiment of the present invention.

FIG. 5 shows a plot of the characteristic impedance measurements 510 of a 25 cm cable in accordance with the present invention as a function of frequency 520. Measurements were made for frequencies between 30 kHz 522 and 3 GHz 524. The characteristic impedance is near 50 ohms. The characteristic impedance 530, as shown in FIG. 5, is uniform over the length of the flat cable. Therefore, signal reflection due to impedance mismatch is minimized. As shown in FIG. 5, the fabricated flat cable has an averaged characteristic impedance 510 of approximately 50Ω 530, over a frequency range 520 of 0.030 MHz 522 to 2 GHz 524. The measured impedance exhibits some fluctuation and deviation at frequencies above 2 GHz, this result may be due to non-uniformity in insulation and connector effects of the prototype. Further, performance of a production grade flexible high speed micro-cable, in accordance with the present invention, can be expected to perform even better.

A cable, such as that shown in FIG. 3*b* with the performance of FIG. 5 provides high-speed data transfer. Performance of a flat cable, fabricated in accordance with the present invention, was evaluated by downloading data from a 512 MB USB 2.0 removable disk to a personal computer. All data was successfully downloaded between the removable disk to a personal computer at full USB 2.0 high speed. The structure of this flat cable is illustrated in FIG. 2*b*, while FIG. 3*b* shows the actual cable used in this performance test.

Figure 6:
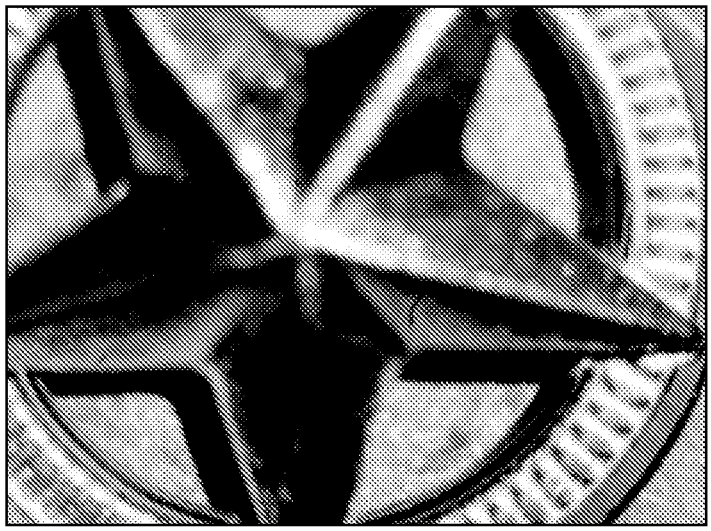
FIG. 6 is an image of a video signal received from a USB 2.0 digital camera through a flexible high speed micro-cable made in accordance with the present invention.

FIG. 6 shows an image of a video signal received from a USB 2.0 digital camera through a 2.0 USB cable, which was made in accordance with the present invention. The image shows that a micro cable made in accordance with the present invention can transmit video quality signals.

Conventional USB cables comprise a twisted pair data cable and have a 90Ω±15% impedance. The twisted pair, D+ and D−, reduce noise and cross-talk. Conventional USB cables use half-duplex differential signaling to combat the effects of electromagnetic noise on longer lines. The two lines usually operate together and are not separate simplex connections. Transmitted signal levels are 0.0 to 300 mV for low and +400 mV for high in high speed 2.0 USB mode. In high speed mode the cable wires have a termination of 45Ω to ground, or 90Ω differential to match the data cable impedance. A High-Speed 2.0 USB cable meets a data transfer rate, frequency, of 480 Mbit/s and a cable fabricated in accordance with the present invention exceeds this data transfer rate, with a 3 dB attenuation not until a frequency of nearly 2000 Megabits/s.

Mini USB and the micro USB connections have many advantages. The most obvious benefit to this new technology is its smaller size. As cell phones and PDAs become thinner and lighter, consumers are frequently finding the mini USB connector is simply too large for practical use. Micro USB connector and cables will allow manufacturers to push the limits of this trend towards sleeker design. A flexible high speed micro-cable, in accordance with the present invention, will find many applications in personal use products.

Flexible high speed micro-cables made in accordance with the present invention out perform conventional USB 2.0 cable specifications, as shown by FIG. 4.

A cable fabricated in accordance with the present invention will be readily automated, lacking the need for steps such as dipping or curing.

Off the shelf 50 μm copper tape provides the desired effective EMI shielding, while polyimide kapton tape provides efficient insulation. Micro-diameter copper wire combines with the aforementioned to provide a unique combination of materials that yield high speed data transfer, exceeding high speed USB 2.0 specifications.

Four conductors in parallel contribute to a flat profile, which is particularly suited for satellite and aerospace applications. The small flat flexible cable, in accordance with an embodiment of the present invention, make it ideal for applications requiring tight clearances, low weight, low volume, and conformity to other than flat contours. A cable in accordance with the present invention can positively contribute to the mass fraction payload of, for example, satellites.

The performance of a cable in accordance with the present invention provides high speed data transfer and video signal transmission capability.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiment and after consideration of the appended claims and drawing.

The invention claimed is:

1. A method of making a flexible micro cable, the method comprising:

arranging four copper conductors of micrometer diameter in parallel, equally spaced apart, and of equal length;

insulating the four conductors by application of a first and second length of polyimide tapes on a top and bottom of the copper conductors, respectively;

applying a first and second 50 micrometer thick copper tape to the outside of each of the first and second polyimide tapes, respectively, along the length of the polyimide tapes, forming the electromagnetic interference shield;

applying an outer layer of polyimide tape to each exposed side of the first and second copper tapes, wherein the outer layer of polyimide tapes have a greater width than a width of the copper tapes; and pressing together outer first and second edges of the outer layer polyimide tapes, which are beyond the width of the copper tapes.

2. The method according to claim 1, further comprising connecting a first and a second USB connector to an each end of the cable.

* * * * *